US010568365B2

(12) United States Patent
Hirakubo

(10) Patent No.: US 10,568,365 B2
(45) Date of Patent: Feb. 25, 2020

(54) WOMAN'S UNDERGARMENT

(71) Applicant: GOLD FLAG LTD., Osaka-shi, Osaka (JP)

(72) Inventor: Akiyo Hirakubo, Osaka (JP)

(73) Assignee: GOLD FLAG LTD., Osaka (JP)

( * ) Notice: Subject to any disclaimer, the term of this patent is extended or adjusted under 35 U.S.C. 154(b) by 0 days.

(21) Appl. No.: 16/344,937

(22) PCT Filed: Oct. 27, 2016

(86) PCT No.: PCT/JP2016/004731
§ 371 (c)(1),
(2) Date: Apr. 25, 2019

(87) PCT Pub. No.: WO2018/078673
PCT Pub. Date: May 3, 2018

(65) Prior Publication Data

US 2019/0261696 A1 Aug. 29, 2019

(51) Int. Cl.
*A41C 3/00* (2006.01)
*A41F 15/00* (2006.01)

(52) U.S. Cl.
CPC ..... *A41C 3/0021* (2013.01); *A41F 15/002* (2013.01)

(58) Field of Classification Search
CPC ... A41C 3/0014; A41C 3/0021; A41C 3/0028; A41F 15/002
USPC ..... 450/1
See application file for complete search history.

(56) References Cited

U.S. PATENT DOCUMENTS

| | | | | |
|---|---|---|---|---|
| 2,560,706 | A * | 7/1951 | Spetalnik | A41C 3/0021 450/74 |
| 9,795,172 | B1 * | 10/2017 | Lee | A41C 3/0021 |
| 2012/0122370 | A1 * | 5/2012 | Heath | A41C 3/0057 450/80 |
| 2013/0122780 | A1 * | 5/2013 | McCall | A41C 3/0028 450/30 |

FOREIGN PATENT DOCUMENTS

| | | | |
|---|---|---|---|
| JP | S47-8673 | B1 | 3/1972 |
| JP | H09-119004 | A | 5/1997 |
| JP | 2008163490 | A | 7/2008 |
| JP | 2008274538 | A | 11/2008 |
| JP | 2010275660 | A | 12/2010 |
| JP | 3171812 | U | 11/2011 |
| JP | 5520421 | B1 | 4/2014 |
| JP | 2015078460 | A | 4/2015 |

(Continued)

OTHER PUBLICATIONS

International Search Report dated Jan. 10, 2017 for PCT/JP2016/004731 and English translation.

(Continued)

*Primary Examiner* — Timothy K Trieu
(74) *Attorney, Agent, or Firm* — Lucas & Mercanti, LLP

(57) ABSTRACT

A woman's undergarment includes a pair of cups, a center cover piece, a front panel, a stretchable tape, a back panel, and shoulder straps. One embodiment of the undergarment prevents cups from slipping upward and allows a wearer's breasts to be pushed toward the sternum and then lifted so as to create natural and beautiful cleavage lines in the decollate area without deforming the breasts.

1 Claim, 7 Drawing Sheets

(56) References Cited

FOREIGN PATENT DOCUMENTS

JP 3202589 U 1/2018

OTHER PUBLICATIONS

Decision of Refusal dated Nov. 7, 2017 for Japanese Application 2017-502284 and English translation.
EPO, Extended European Search Report from the corresponding European Patent Application No. 16919801.7, dated Aug. 12, 2019 (7 pages).

* cited by examiner

WOMAN'S UNDERGARMENT

CROSS REFERENCE TO RELATED APPLICATION

This application is a 371 of PCT/JP2016/004731 filed on Oct. 27, 2016 which is incorporated herein by reference.

TECHNICAL FIELD

The present invention relates to improvements in undergarments for women such as brassieres and camisoles having a pair of left and right cups.

BACKGROUND ART

Making their bodies look more beautiful and attractive is one of the fundamental interests of women of all ages all over the world. In particular, making their breasts look well-shaped is their strong desire. To satisfy this desire, underwear manufactures have conventionally developed and marketed various undergarments having cups such as brassieres and camisoles.

There are two main types of undergarments having cups (brassieres as a typical example of such undergarments are described below). One is an underwire brassiere provided with wires arranged along the lower edges of cups (usually corresponding to barge scan lines) (see Patent Literature 1), and the other is a wireless (non-wire or wire-free) brassiere without such wires (see Patent Literature 2).

When an underwire brassiere provided with wires along the lower edges of cups is put on so that the wires conform to the barge scan lines of breasts, the wires can support the breasts stably from below to form beautifully shaped breasts and keep the beautiful shape of the breasts for a long time. However, since the wires themselves are made of a rigid material such as a metal or a resin, they bite into the skin of a wearer and make her feel pain after a long period of wearing, which is considered as a drawback of underwire brassieres.

In contrast, in the case of a wireless brassiere provided with no such wires that could bite into the skin, a portion of each cup of the brassiere conforming to the barge scan line has a soft texture and makes the wearer feel comfortable. Therefore, wireless brassieres are particularly well received by elderly women, and recently these wireless brassieres are becoming the dominant type of brassieres.

The wearing comfort of wireless brassieres is much higher than that of underwire brassieres, but wireless brassieres have the following drawback. Even if a wireless brassiere is put on to create beautiful barge scan lines, cups gradually slip upward (particularly when the wearer is a large-breasted woman) during a long period of wearing and cause loss of the beautifully created barge scan lines, resulting in loss of the breast shape.

In addition, underwire brassieres and wireless brassieres have the common problem to be solved, i.e., the fit of a brassiere to the breasts of the wearer. The breast size varies from one woman to another, but it is absolutely impossible for underwear manufacturers to offer a wide variety of undergarment sizes (particularly cup sizes) for all individuals, and the variety of sizes that they can offer is limited to a certain range as a matter of course. As a result, a subtle difference between the cup size and the breast size cannot be eliminated. In particular, this subtle difference makes the wearers feel uncomfortable after a long period of wearing, and thus the wearers' dissatisfaction with the fit of brassieres cannot be resolved.

Of course, it may be possible to some extent to accommodate a wide variety of cup sizes to improve the wearing comfort, but the discomfort caused by the size difference mentioned above cannot be completely eliminated. In addition, such a wide variety of sizes causes inefficient inventory management, resulting in an increase in cost, as another problem. To solve these problems and drawbacks of conventional wireless brassieres, wireless brassieres with a limited number of sizes but with improved fit have been proposed (see Patent Literature 3 and FIG. 6 attached herewith).

A wireless brassiere 100 described in Patent Literature 3 includes: a pair of left and right cups 120 made of a stretchable fabric; a base panel 140 (front panel) provided along the lower edges 120*a* of the cups 120; stretchable tapes 170, each of which is made of a long strip of mesh tape and sewn to both the lower edge 120*a* of the cup 120 and the cup-side edge 180*a* of the base panel 140 so as to indirectly connect the cup 120 and the base panel 140 along the entire length of their edges; a back panel 400; and shoulder straps 200.

These stretchable tapes 170 are each disposed between the lower edge 120*a* of the cup 120 and the cup-side edge 180*a* of the base panel 140 and sewn to both of these edges extending along a line from the shoulder to the lower part of the sternum in the center of the chest (FIG. 6).

These stretchable tapes 170 each conform to the entire length of the barge scan line V and softly fit under the barge scan line V, and thus support the breast from below to prevent the cup 120 from slipping upward without an underwire.

The stretchable tapes 170 are highly elastic and stretchable in their longitudinal direction and a direction perpendicular to the barge scan lines V. Therefore, the stretchable tapes 170 are stretched to fit larger breasts, while they are compressed (or slightly stretched) to fit smaller breasts.

With these stretchable tapes, the brassiere 100 of a given size can cover a certain range of breast sizes, regardless of whether the breasts are large or small, and thus the number of sizes required can be reduced, which makes the inventory management easier.

However, the brassiere 100 is required to have not only the function of supporting the breasts from below while preventing the cups 120 from slipping upward but also the function of pushing the breasts in the cups 120 inwardly toward the center of the chest and lifting them to create cleavage lines D of a beautifully formed breast cleavage in the decollete area. To meet these requirements, it is necessary to add volume to the breasts. Therefore, when the conventional brassiere 100 is put on, flab under the arms is forced into the cups 120 to add the volume to the wearer's own breasts and push the breasts and the flab together inwardly and lift them, as described above.

When this brassiere 100 is worn, an outer end portion of each of the cups 120 is pulled up by the pull-up action of the shoulder strap 200, with a connection point Pj between the cups 120 located at the lower part of the sternum remaining fixed, while the breast in the cup 120 is pushed inwardly toward the sternum by the reaction to the pulling-up by the shoulder strap 200, as indicated by thick arrows F1.

The stretchable tapes 170 of the wireless brassiere 100 are each sewn to the entire length of the lower edge 120*a* of the cup 120 (extending from a shoulder strap sewing portion Pu of each of the left and right cups 120 to the connection point Pj located at the "lower part of the sternum"). Therefore, when the breast is pushed toward the sternum, a portion of the stretchable tape 170 near the lower part of the sternum is significantly stretched as indicated by up- and down-arrows F2, and as a result, the force of pushing the breast upwardly is reduced as indicated by thin up-arrows F3, and thus beautiful, deep cleavage lines D of voluminous breasts cannot be created.

An invention as shown in Patent Literature 4 (FIG. 7 to FIG. 9) has been proposed as a wireless brassiere 110 configured to push breasts inwardly toward the sternum and then push them upwardly so as to form cleavage lines D.

This invention discloses that triangular ribs 190 are each formed on the inner face of the sternum-side panel of the cup 120, and the breasts pushed inwardly toward the sternum are pushed against the ribs 190 so as to push the corresponding portions of the breasts upwardly and form cleavage lines D.

This technique allows the formation of acceptable cleavage lines D. However, the triangular ribs 190 provided in the vicinity of the sternum push and deform the corresponding portions of the breasts located near the lower part of the sternum, and as a result, portions of the cleavage lines D corresponding to the pushed portions of the breasts near the lower part of the sternum are pushed and slightly deformed and the deformed portions Dh are noticeable in the appearance. These deformed portions Dh are lightly shaded in FIG. 7. It should be noted that this wireless brassiere 110 includes hooked belts 400' instead of the back panel 400.

CITATION LIST

Patent Literature

[PTL 1] Japanese Laid-Open Patent Publication No. 2008-274538 (FIG. 1)

[PTL 2] Japanese Laid-Open Patent Publication No. 2008-163490 (FIG. 1)

[PTL 3] Japanese Laid-Open Patent Publication No. 2010-275660

[PTL 4] Japanese Patent No. 5520421

SUMMARY OF INVENTION

Technical Problem

The present invention has been made in view of the above conventional techniques, and it is an object of the present invention to provide a novel wireless brassiere that prevents cups from slipping upward and allows a wearer's breasts to be pushed toward the sternum and then lifted so as to create natural and beautiful cleavage lines in the decollete area without deforming the breasts.

Solution to Problem

An invention according to claim 1 is a woman's undergarment A including:

a pair of left and right cups 12;

a center cover piece 13 that has a substantially triangular shape whose oblique sides 13*b* are each sewn to an oblique side sewing portion 12*e* of one of the left and right cups 12 that extends from a connection point P0 at which the left and right cups 12 are connected at inner ends thereof to a middle point P1 of a lower edge 12*a* of the one of the left and right cups 12;

a front panel 14 that is provided along a line connecting a bottom side 13*a* of the center cover piece 13 and lower edge underarm-side portions 12*d* of the left and right cups 12 each extending from the middle point P1 of the lower edge 12*a* to an outer end P2 of the lower edge 12*a;* a stretchable tape 17 that is provided between the front panel 14 and the line connecting the bottom side 13*a* of the center cover piece 13 and the lower edge underarm-side portions 12*d* and is sewn to the front panel 14, the bottom side 13*a* of the center cover piece 13, and the lower edge underarm-side portions 12*d* so as to connect the front panel 14, the bottom side 13*a*, and the lower edge underarm-side portions 12*d;* a back panel 16 that is connected to the front panel 14 or hooked belts 16' that are connected to the front panel 14;

shoulder straps 20 that are sewn to the cups 12 and the back panel 16 or the belts 16'; and left and right upper edge tapes 19 that are each provided along an upper edge 12*u* of one of the left and right cups 12 and one of the oblique sides 13*b* of the center cover piece 13 and intersect each other at the front of the undergarment A, and that are both stretchable in longitudinal directions thereof, wherein the left and right upper edge tapes 19 are sewn to each other at the intersection, and the stretchable tape 17 has stretchability in both longitudinal and transverse directions thereof.

Advantageous Effects of the Invention

In the configuration described above, portions of the stretchable tape 17 having stretchability in both longitudinal and transverse directions thereof are each sewn to the lower edge underarm-side portion 12*d* of the cup 12. These portions of the stretchable tape 17 are stretched or compressed not only to fit the breasts in the cups 12 but also to fit under the barge scan lines V, and thus the cups 12 can be prevented from slipping upward. In addition, the remaining portion of the stretchable tape 17 that is sewn to the bottom side 13*a* of the center cover piece 13 is connected to the left and right cups 12 at the middle points P1, and thus the breasts in the cups 12 can be pushed toward the sternum effectively.

Furthermore, the left and right upper edge tapes 19 that are each provided along the upper edge 12*u* of one the left and right cups 12 and one of the oblique sides 13*b* of the center cover piece 13 and intersect each other at the front of the undergarment A, and that are both stretchable in longitudinal directions thereof are sewn to each other at the intersection, and the oblique sides 13*b* of the center cover piece 13 are each sewn to the oblique side sewing portion 12*e*. Therefore, the center cover piece 13 is pulled up by the resultant forces F7 generated on the oblique sides 13*b* from the pull-up forces F6 of the shoulder straps 20 in directions toward the left and right shoulders and thus the portions Bm of the breasts that have been pushed toward the sternum are pulled up by the center cover piece 13, as shown in FIG. 1. The oblique sides 13*b* of the center cover piece 13 pull up the entire portions Bm of the breasts without deforming them, and thus unprecedented natural cleavage lines D can be formed.

BRIEF DESCRIPTION OF DRAWINGS

FIG. 2 is a partially cut-away rear view showing how the back side of the undergarment of FIG. 1 looks like.

DESCRIPTION OF EMBODIMENTS

Hereinafter, the present invention will be described with reference to drawings. A woman's undergarment A according to the present invention is an undergarment, such as a brassiere 10 or a camisole 10', having a pair of cups 12. Hereinafter, the brassiere 10 will be described as a typical example.

Figure 1:
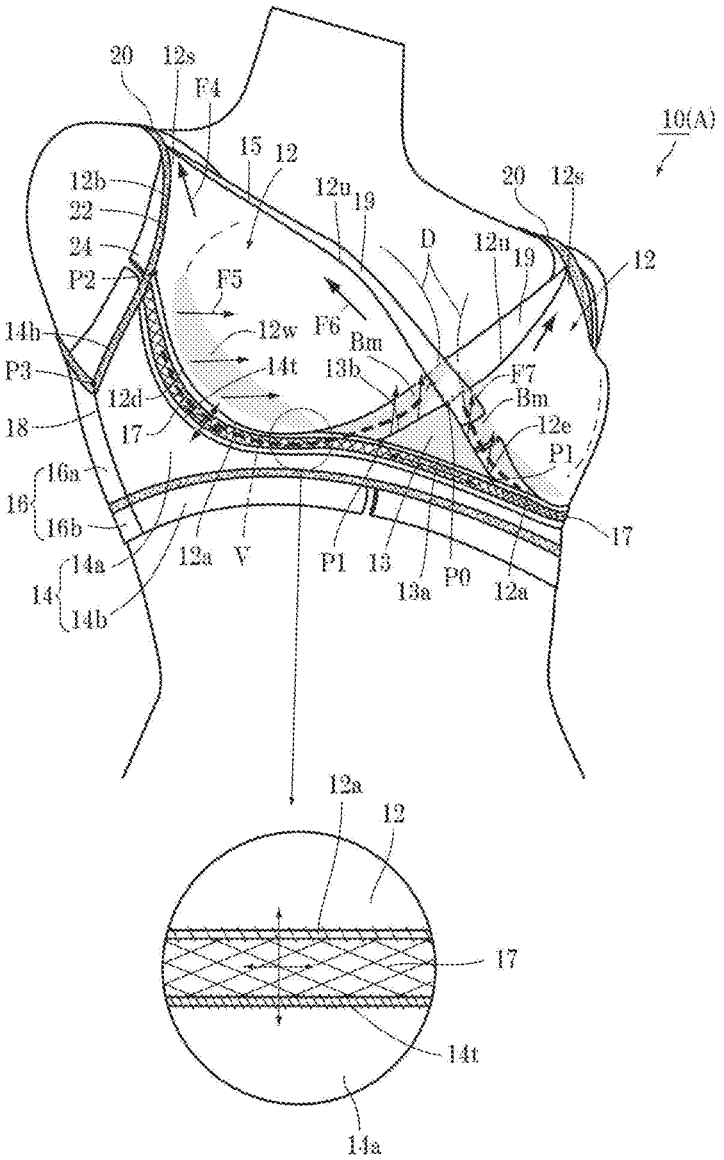
FIG. 1 is a perspective view showing how a woman's undergarment according to a first embodiment of the present invention is worn.
Figure 2:
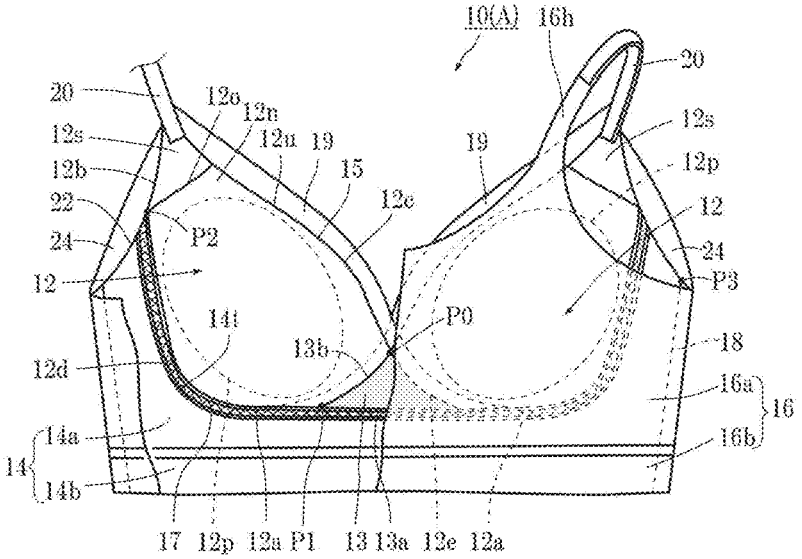
Figure 3:
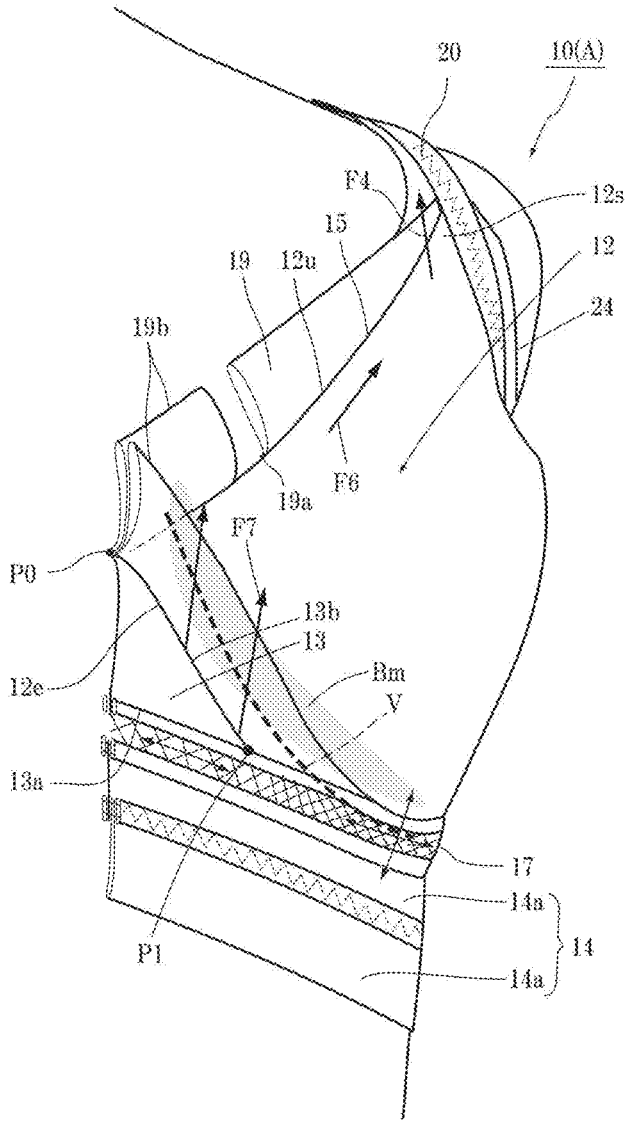
FIG. 3 is a perspective view of a central vertical section of FIG. 1.

The brassiere 10 (first embodiment) shown in FIG. 1 to FIG. 3 mainly includes a pair of left and right cups 12, a center cover piece 13, a front panel 14, a back panel 16, a stretchable tape 17, shoulder straps 20, and optionally upper edge tapes 19 and underarm pads 24.

Figure 5:
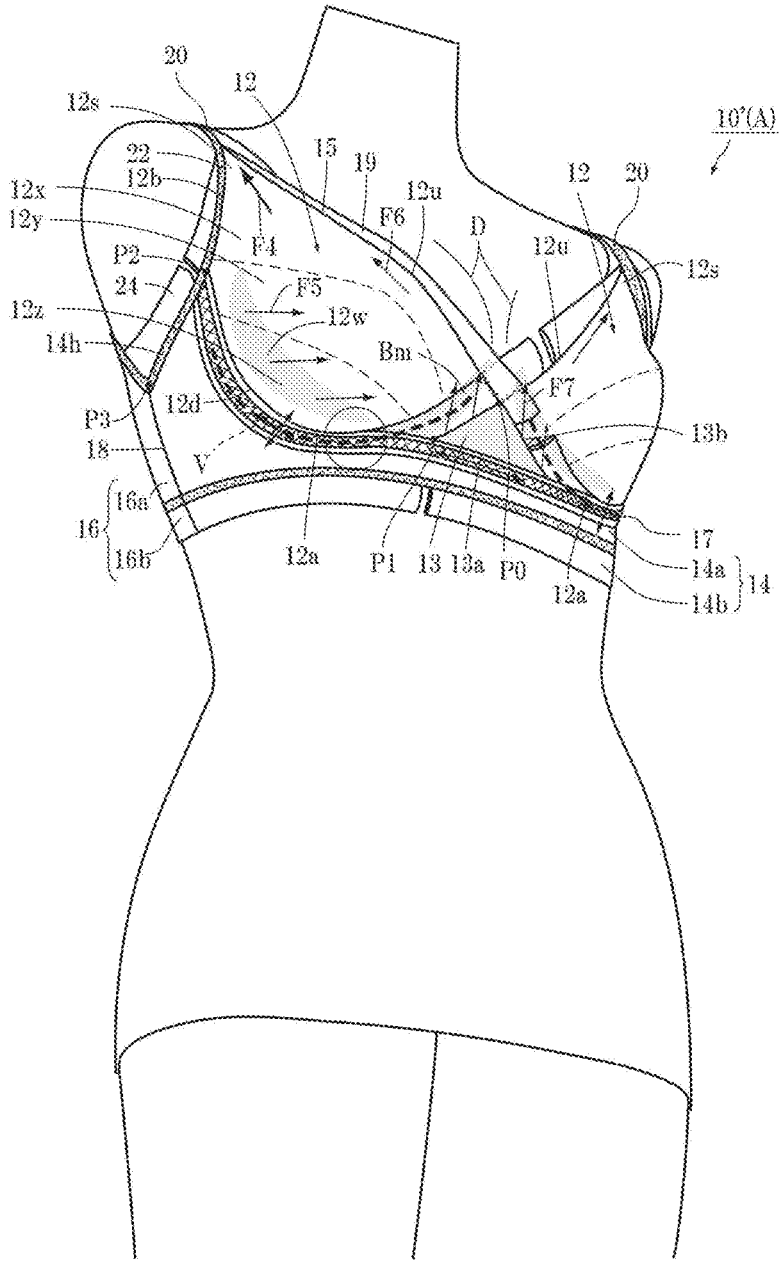
FIG. 5 is a perspective view showing how a woman's undergarment (camisole) according to a third embodiment of the present invention is worn.
Figure 6:
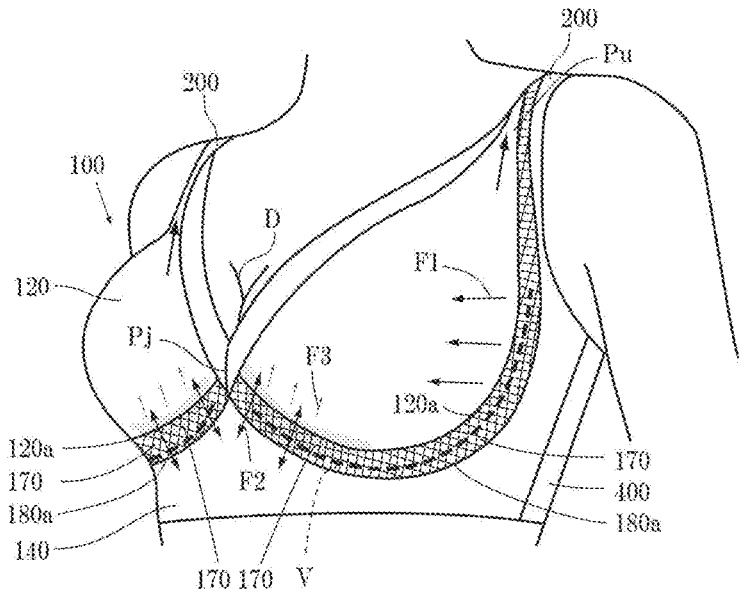
FIG. 6 is a perspective view showing how a conventional brassiere is worn.
Figure 7:
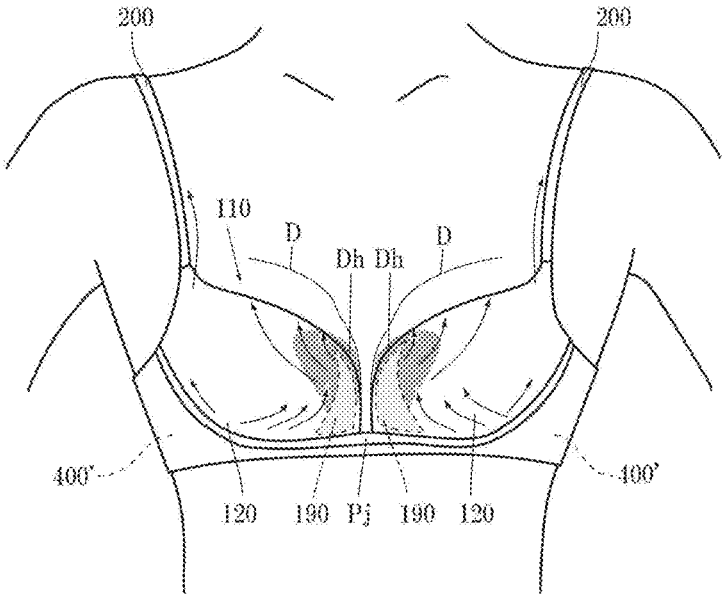
FIG. 7 is a front view showing how another conventional brassiere is worn.
Figure 8:
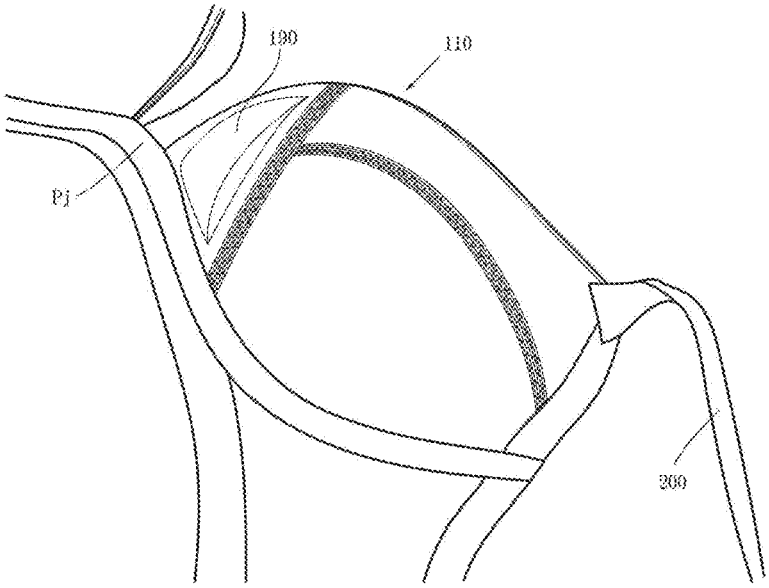
FIG. 8 is a partially enlarged perspective view of the inside of the brassiere of FIG. 7.
Figure 9:
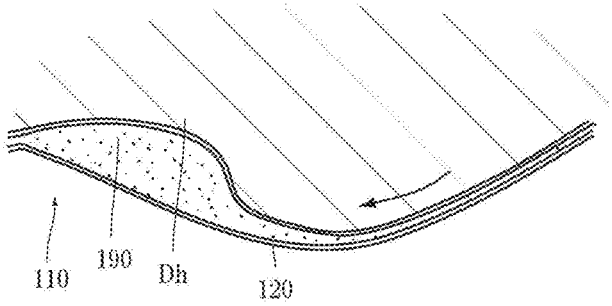
FIG. 9 is a horizontal sectional view showing deformation of a breast within the brassiere of FIG. 7.

The cups 12 are each, for example, a cup-shaped seamless single piece formed by die molding of elastic polyurethane fibers to cover a breast. The cup 12 may be a cup-shaped piece formed of three parts: an upper cover strip 12*x* extending laterally to cover the upper part of the breast; a lower cover strip 12*z* extending laterally to cover the lower part of the breast; and a middle cover strip 12*y* provided between the upper cover strip 12*x* and the lower cover strip 12*z*, as shown in FIG. 5.

The cup 12 is elastically stretchable in both vertical and horizontal directions, but the horizontal stretchability of the cup 12 is higher than the vertical stretchability thereof.

Alternatively, the cup 12 may be a cup-shaped piece formed by die molding of a cloth-covered foam sheet material composed of layers of a foam sheet material and a cloth (or clothes) attached to one surface (or both surfaces) of the sheet material, with the covering cloth facing outward, although not shown here.

The cups 12 each have a shell or spindle shape, as shown in FIG. 1 and FIG. 2, and are connected together at their inner ends. The upper edges 12*u* of the left and right cups 12 each extend obliquely upward and outward from a connection point P0 at which the left and right cups 12 are connected as described above to the shoulder strap sewing portion 12*s*. The upper edge 12*u* is formed in a convex arc having a large radius of curvature. On the other hand, the lower edge 12*a* of the cup 12 is formed in a downwardly and outwardly convex arc having a smaller radius of curvature than the upper edge 12.

In the first embodiment, the outer end P2 of the lower edge 12*a* does not coincide with the shoulder strap sewing portion 12*s* provided at the outer end of the upper edge 12*u* and is located on the front side of the armhole. In FIG. 1, the lower edge 12*a* corresponds to a portion from the connection point P0 to the outer end P2 on the front side of the armhole. It is to be understood that the shape of the lower edge 12*a* is not limited to this, and the position of the outer end P2 may be shifted upward to the shoulder strap sewing portion 12*s*.

The connection point between the lower edge 12*a* and one end of the bottom side 13*a* of the center cover piece 13 to be described later is referred to as a middle point P1 of the lower edge 12*a*.

In the present embodiment, the outer ends P2 are each located at a position spaced from the shoulder strap sewing portion 12*s*, and the edge between the outer end P2 and the shoulder strap sewing portion 12*s* is referred to as an outer edge 12*b*.

As shown in FIG. 2, a pocket patch 12*n* is attached to the back side of each of the cups 12 to form a pocket for accommodating an elastic cup-shaped pad 12*p* therein. The material of the pocket patch 12*n* is an elastic polyurethane fabric that is elastically stretchable both vertically and horizontally like the material of the cup 12. Like the cup 12, the pocket patch 12*n* may be a cup-shaped seamless single piece formed by die molding or a cup-shaped piece composed of three parts. Like the cup 12, the horizontal stretchability of the pocket patch 12*n* is higher than the vertical stretchability thereof.

The pocket formed by the pocket patch 12*n* has an opening 12*o* into and from which the folded pad 12*p* can be put and removed, and thus the width of the opening 12*o* must be large enough to put the half-folded pad 12*p* thereinto and remove it therefrom. The pocket of the cup 12 has a capacity large enough to extend the folded pad 12*p* and accommodate it therein.

The opening 12*o* is provided along a line connecting a point near the shoulder strip sewing portion 12*s* on the upper edge 12*u* of the cup 12 and the outer end P2 of the lower edge 12*a*, and the periphery of the pocket patch 12*n*, except for the opening 12*o*, is sewn to the outer periphery of the cup 12. It should be noted that the pocket patches 12*n* and the pads 12*p* may be optionally provided. For example, they may be omitted if the cups 12 are made of a cloth-covered molded foam sheet material.

The pad 12*p* is formed as follows. A foam sheet material whose surfaces are covered with clothes is formed into a cup shape by die molding and then the edge of the cup shape is trimmed into a circular shape. The pad 12*p* is formed to have a thickness that gradually decreases from the thickest central portion toward the periphery thereof. Various sizes of pads having different thicknesses are prepared for various breast sizes.

The isosceles triangular center cover piece 13 is formed of an elastic polyurethane fabric that is elastically stretchable both vertically and horizontally, and the oblique sides 13*b* of the center cover piece 13 are each sewn to the oblique side sewing portion 12*e* extending from the connection point P0 between the cups 12 to the middle point P1 of the lower edge 12*a* of the cup 12. When the upper edge tape 19 to be described later is provided, a portion thereof is also sewn to the oblique side sewing portion 12*e* together with the oblique side 13*b*.

The center cover piece 13 is a single fabric piece and is sewn such that it can be stretched in the vertical direction more than in the chest circumference direction (i.e., the horizontal direction).

In the embodiment shown in FIG. 1 to FIG. 3, the front panel 14 is composed of an upper support piece 14*a* and a lower support piece 14*b*. The front panel 14 may be a single-piece panel, but a two-piece panel including the upper support piece 14*a* and the lower support piece 14*b* is mainly described here.

As can be seen in FIG. 1 and FIG. 2, the upper edge of the upper support piece 14*a* is composed of the bottom side 13*a* of the center cover piece 13, U-shaped corresponding sides 14*t* corresponding to the left and right lower edge underarm-side portions 12*d*, and underarm oblique sides 14*h* each extending from the outer end P2 to an upper end P3 of a seam line 18 with the back panel 16 under the arm.

The straight lower edge of the upper support piece 14*a* is directly connected to the lower support piece 14*b*. The upper support piece 14*a* is a single fabric piece formed of an elastic polyurethane fabric that is elastically stretchable both vertically and horizontally. The horizontal stretchability (i.e., the stretchability in the chest circumference direction) of the upper support piece 14*a* is higher than the vertical stretchability thereof.

The lower support piece 14*b* also is formed of an elastic polyurethane fabric that is elastically stretchable both vertically and horizontally, and the horizontal stretchability (i.e., the stretchability in the chest circumference direction) of the lower support piece 14*b* also is higher than the vertical stretchability thereof. The lower support piece 14*b* is made of a folded double-layer fabric piece, and the folded edge of the fabric piece serves as the lower edge thereof while the double-layer upper edge is sewn to the lower edge of the upper support piece 14*a* such that it can be elastically stretched in the horizontal direction (i.e., in the chest circumference direction).

The stretchable tape 17 connects the pair of connected left and right cups 12, the center cover piece 13 provided between the cups 12, and the upper edge of the upper support piece 14*a* provided with a predetermined distance from the cups 12 and the center cover piece 13, and serves not only as conventional wires but also as a stretchable adjuster for holding the breasts.

The stretchable tape 17 is sewn to the cups 12 along the lower edge underarm-side portions 12*d* up to the middle points P1 and then sewn to the bottom side 13*a* of the center cover piece 13.

In the present embodiment, a mesh tape formed of a mesh of thick elastic fibers that are crossed obliquely to the longitudinal direction thereof is used as the stretchable tape 17. It is to be understood that the stretchable tape 17 is not limited to a mesh tape and any material can be used as long as it is elastically stretchable in both the longitudinal direction thereof and a direction perpendicular thereto (i.e., a transverse direction).

The degree of stretching of the stretchable tape 17 in the transverse direction (perpendicular to the longitudinal direction) is higher than that in the longitudinal direction. The force required to stretch the stretchable tape 17 in the longitudinal direction is greater than that in the transverse direction. This means that when the brassiere 10 is worn, the stretchable tape 17 is stretched more easily with a smaller force in the transverse direction so that the brassiere is fitted more closely to the breasts, and at the same time, the cups 12 are pulled inwardly with a greater pulling force.

The back panel 16 is composed of an upper back panel 16*a* that covers a portion of the wearer's back and a lower back panel 16*b* that is sewn to the lower edge of the upper back panel 16*a*. The back panel 16 is sewn to the front panel 14 under the arms to form seam lines 18.

The material of the back panel 16 is an elastic polyurethane fabric that is elastically stretchable both vertically and horizontally, and the horizontal stretchability (i.e., the stretchability in the chest circumference direction) of both the upper back panel 16*a* and the lower back panel 16*b* is higher than the vertical stretchability thereof.

The upper back panel 16*a* is a single fabric piece like the upper support piece 14*a*. The lower back panel 16*b* is a folded double-layer fabric piece like the lower support piece 14*b*, and the folded edge of the fabric piece serves as the lower edge thereof while the double-layer upper edge is sewn to the lower edge of the upper back panel 16*a* such that it can be elastically stretched in the horizontal direction.

The shoulder straps 20 are each provided between a shoulder strap sewing portion 12*s* extending upward from the cup 12 and a shoulder strap connecting piece 16*h* extending upward from the upper edge of the upper back panel 16*a*, and one end of the shoulder strap 20 is sewn to the shoulder strap sewing portion 12*s* and the other end thereof is sewn to the shoulder strap connecting piece 16*h*, respectively. The shoulder strap 20 may be an ordinary strap, but the shoulder strap 20 here is a double-layer fabric strap, and its longitudinal stretchability is higher than its transverse stretchability.

The upper edge tapes 19 are each provided along the upper edge 12*u* of the cup 12 and the oblique side 13*b* of the center cover piece 13, and they intersect each other at the front of the brassiere 10. The upper edge tape 19 is a double-layer fabric tape made of an elastic polyurethane fabric that is elastically stretchable both longitudinally and transversely, and can be stretched in the longitudinal direction more than in the direction perpendicular thereto (a transverse direction).

Here, an inclined side composed of the upper edge 12*u* of one of the cups 12 to which the upper edge tape 19 is sewn and the oblique side 13*b* of the center cover piece 13 that is sewn to the oblique side sewing portion 12*e* of the other cup 12 is referred to as a tape sewing side 15. The tape sewing sides 15 each extend from the shoulder strap sewing portion 12*s* of one of the cups 12 to the middle point P1 of the lower edge 12*a* of the other cup 12, and they intersect each other at the front of the brassiere 10, that is, the vertex of the center cover piece 13 (coinciding with the connection point P0).

The double-layer edge 19*a* of the fabric of the upper edge tape 19 is sewn to the tape sewing side 15 as described above and reaches the upper edge of the stretchable tape 17 at the middle point P1. On the other hand, the folded edge 19*b* opposite to the double-layer edge 19*a* forms a fold as a free edge that is not sewn to any portion (see FIG. 3).

The folded edge 19*b* of the upper edge tape 19 is not sewn to any portion and merely forms a fold. Therefore, the folded edge 19*b* of the upper edge tape 19 sewn to the cup 12 softly touches the breast without applying any additional force to the breast, and thus does not deform the shape of the cleavage line D. The upper edge tapes 19 are sewn and restrained to each other across the full width thereof at the connection point P0 of the cups 12 at which the upper edge tapes 19 intersect each other.

Underarm pads 24 are optionally provided. The underarm pads 24 each have a crescent shape and high hygroscopicity. The underarm pads 24 are each a double-layer fabric that is equally stretchable in both longitudinally and transversely and are each provided along the front armhole edge 22 extending from the shoulder strap sewing portion 12*s* of the cup 12 to the upper end P3 of the seam line 18 between the front panel 14 and the back panel 16 via the outer end P2. The transverse edge of the underarm pad 24 is sewn not only to the front armhole edge 22 but also to a portion of the back panel 16 beyond the upper end P3 of the seam line 18.

Next, how to put on this brassiere 10 will be described. A user selects this brassiere 10 and the pads 12*p* suitable for her body shape and breasts and inserts the pads 12*p* into the pockets of the brassiere 10.

Then, when the user puts on this brassiere 10, she gathers underarm and back flab, pushes the flab toward the breasts, and puts the flab and her own breasts into the cups 12.

A portion of the stretchable tape 17 that is sewn to a portion extending from the outer end P2 of the cup 12 to the middle point P1 of the cup 12 is stretched both longitudinally and transversely depending on the volume of the breast held in the cup 12. This portion of the stretchable tape 17 softly fits under the barge scan line V extending from the outer end P2 to the middle point P1, and a gray-shaded underarm-side portion 12*w* of the cup 12 formed along the portion from the outer end P2 to the middle point P1 supports the corresponding portion of the breast from below as if the breast were held in the palm of the hand.

The shoulder straps 20 are each connected to the shoulder strap sewing portion 12*s* of the cup 12 and pulls up the upper outer end of the cup 12. This pull-up force F4 allows the corresponding portion of the breast that is supported by the underarm-side portion 12*w* held in the cup 12 to be pushed toward the center of the chest as shown by arrows F5 (FIG. 1).

At the same time, a portion of the stretchable tape 17 that is sewn to the bottom side 13*a* of the center cover piece 13 is stretched to generate tension when the brassiere 10 is worn. This portion of the stretchable tape 17 helps the remaining portion thereof to softly fit under the barge scan lines V and pulls the breasts and the underarm-side portions 12*w* of the cups 12 toward the sternum.

On the other hand, the center cover piece 13 is provided in the region near the lower part of the sternum, and the oblique sides 13*b* of the center cover piece 13 are respectively sewn to the oblique side sewing portions 12*e* extending from the connection point P0 to the middle points P1 of the cups 12. Therefore, a portion of the cup 12 along the upper edge 12 thereof is pulled obliquely upward by the shoulder strap 20 from the sternum side toward the shoulder. Since this pull-up force F6 is applied to each of the oblique sides 13*b* of the center cover piece 13, the horizontal components of the pull-up force F6 are cancelled out and only the resultant upward force F7 remains. As a result, the center cover piece 13 is pulled up by this resultant force F7.

The stretchable tape 17 having high vertical stretchability is sewn to the bottom side 13*a* of the center cover piece 13, and thus does not prevent the center cover piece 13 from being pulled up.

The bottom side 13*a* of the center cover piece 13 is compressed by the stretchable tape 17, as described above. Therefore, the center cover piece 13 fits closely to the lower part of the sternum of the wearer, and the oblique side sewing portions 12*e* of the cups 12 to which the oblique sides 13*b* of the center cover piece 13 are sewn each fit along the corresponding portion of the barge scan line V of the wearer's breast.

When the center cover piece 13 is pulled up as described above, the breasts pushed toward the sternum are each lifted in such a manner that the gray-shaded portions Bm of the breasts along the oblique side sewing portions 12*e* are entirely held in the corresponding portions of the cups 12 without being deformed. Thus, natural cleavage lines D are formed.

It should be noted that the upper edge tapes 19 are each sewn to the tape sewing side 15 extending along the upper edge 12*u* of the cup 12 and the oblique side 13*b* of the center cover piece 13 and they intersect each other at the connection point P0 of the cups 12, as described above. Since the upper edge tapes 19 are sewn to each other at the intersection and are elastically stretched in their longitudinal directions, they serve to increase the pull-up force F6 when the brassiere is worn.

Figure 4:
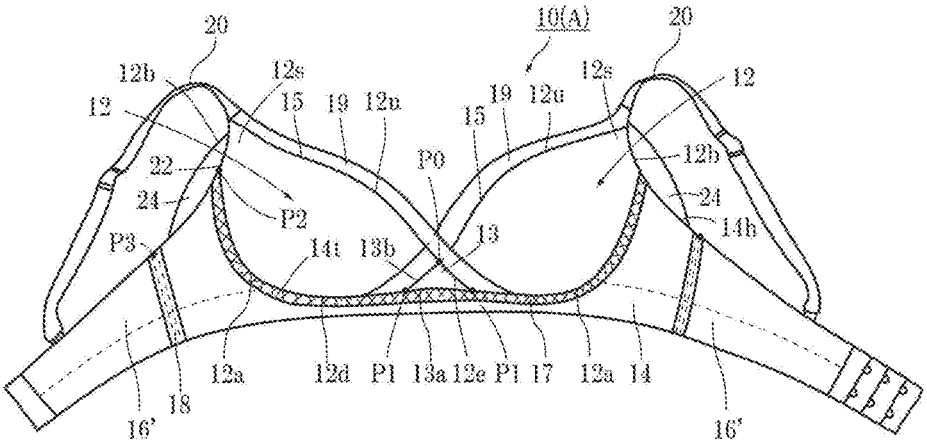
FIG. 4 is a front view of a woman's undergarment according to a second embodiment of the present invention.

FIG. 4 shows the second embodiment of the present invention, in which hooked belts 16' are provided instead of the back panel 16. FIG. 5 shows the third embodiment of the present invention, in which the brassiere 10 is applied to a camisole 10'. Both of these embodiments have the same functions and effects as those of the first embodiment.

REFERENCE SIGNS LIST

A: Woman's undergarment
Bm: Portion of breast (pushed toward sternum)
D: Cleavage line
Dh: Deformed portion
P0: Connection point
P1: Middle point
P2: Outer end
P3: Upper end of seam line
Pj: Connection point
Pu: Shoulder strap sewing portion
F1, F2, F3: Arrows
F4: Pull-up force
F5: Arrow
F6: Pull-up force
F7: Resultant force
V: Barge scan line
10: Brassiere
10': Camisole
12: Cup
12*a*: Lower edge
12*b*: Outer edge
12*d*: Lower edge underarm-side portion
12*e*: Oblique side sewing portion
12*n*: Pocket patch
12*o*: Opening
12*p*: Pad
12*s*: Shoulder strap sewing portion
12*u*: Upper edge
12*w*: Underarm-side portion
12*x*: Upper cover strip
12*y*: Middle cover strip
12*z*: Lower cover strip
13: Center cover piece
13*a*: Bottom side
13*b*: Oblique side
14: Front panel
14*a*: Upper support piece
14*b*: Lower support piece
14*h*: Underarm oblique side
14*t*: Corresponding side
15: Tape sewing side
16: Back panel
16*a*: Upper back panel
16*b*: Lower back panel
16*h*: Shoulder strap connecting piece
16': Hooked belt
17: Stretchable tape
18: Seam line
19: Upper edge tape
19*a*: Double-layer edge
19*b*: Folded edge
20: Shoulder strap
22: Front armhole edge
24: Underarm pad
100, 110: Conventional wireless brassieres

120: Cup
120*a*: Lower edge
140: Base panel (Front panel)
170: Stretchable tape
180*a*: Cup-side edge
190: Rib
200: Shoulder strap
400: Back panel
400': Belt

The invention claimed is:

1. A woman's undergarment comprising:

a pair of left and right cups;

a center cover piece that has a substantially triangular shape whose oblique sides are each sewn to an oblique side sewing portion of one of the left and right cups that extends from a connection point at which the left and right cups are connected at inner ends thereof to a middle point of a lower edge of the one of the left and right cups;

a front panel that is provided along a line connecting a bottom side of the center cover piece and left and right lower edge underarm-side portions of the left and right cups each extending from the middle point of the lower edge to an outer end of the lower edge;

a stretchable tape that is provided between the front panel and the line connecting the bottom side of the center cover piece and the left and right lower edge underarm-side portions and is sewn to the front panel, the bottom side of the center cover piece, and the left and right lower edge underarm-side portions so as to connect the front panel, the bottom side, and the left and right lower edge underarm-side portions;

a back panel that is connected to the front panel or hooked belts that are connected to the front panel;

shoulder straps that are sewn to the cups and the back panel or the belts; and left and right upper edge tapes that are each provided along an upper edge of one of the left and right cups and one of the oblique sides of the center cover piece and intersect each other at the front of the undergarment, wherein the left and right upper edge tapes are both stretchable in longitudinal directions thereof, the left and right upper edge tapes are sewn to each other at the intersection, and the stretchable tape has stretchability in both longitudinal and transverse directions thereof.

* * * * *